US008698026B2

(12) United States Patent
Roceereto

(10) Patent No.: US 8,698,026 B2
(45) Date of Patent: Apr. 15, 2014

(54) PUSH BUTTON SWITCH WITH ANTI-JAMMING PROTECTION DEVICE

(75) Inventor: Pietro Roceereto, Sumirago (IT)

(73) Assignee: BTICINO S.p.A., Milan (IT)

( * ) Notice: Subject to any disclaimer, the term of this patent is extended or adjusted under 35 U.S.C. 154(b) by 240 days.

(21) Appl. No.: 13/054,319

(22) PCT Filed: Jun. 16, 2009

(86) PCT No.: PCT/EP2009/057441
§ 371 (c)(1),
(2), (4) Date: May 17, 2011

(87) PCT Pub. No.: WO2010/006867
PCT Pub. Date: Jan. 21, 2010

(65) Prior Publication Data

US 2011/0220478 A1 Sep. 15, 2011

(30) Foreign Application Priority Data

Jul. 16, 2008 (IT) ..... RM2008A0386

(51) Int. Cl.
*H01H 13/06* (2006.01)

(52) U.S. Cl.
USPC ..... 200/339; 200/302.2; 200/345

(58) Field of Classification Search
USPC ..... 200/302.1–302.3
See application file for complete search history.

(56) References Cited

U.S. PATENT DOCUMENTS

| | | | | |
|---|---|---|---|---|
| 3,749,859 | A * | 7/1973 | Webb et al. | 200/5 R |
| 2006/0278510 | A1 * | 12/2006 | Nishimura et al. | 200/314 |
| 2007/0108034 | A1 * | 5/2007 | Rix et al. | 200/520 |
| 2009/0000935 | A1 * | 1/2009 | Calderara | 200/523 |

FOREIGN PATENT DOCUMENTS

| | | |
|---|---|---|
| EP | 0 271 674 | 6/1988 |
| EP | 1 386 716 A1 | 2/2004 |
| EP | 1 584 096 B1 | 10/2005 |
| GB | 1 203 419 | 8/1970 |
| WO | 2006/106554 | 10/2006 |

* cited by examiner

*Primary Examiner* — Renee Luebke
*Assistant Examiner* — Ahmed Saeed
(74) *Attorney, Agent, or Firm* — Kenyon & Kenyon LLP

(57) ABSTRACT

A push button switch includes: a support structure of a generally box-like shape, defining an internal space, the support structure having at least an opening communicating with the internal space and an opening axis, the opening being defined by an internal opening edge; an actuation mechanism having a push button and a mechanical coupling arrangement for connecting the push button to the support structure, the mechanical coupling arrangement having a guiding arrangement for the push button to traverse with respect to the support structure in a direction generally parallel to the opening axis; a key which is fixable to the push button for manually actuating the push button; and an anti-jamming protection device having a protective plug interposable between the key and push button and being appliable onto the support structure for interacting with the internal edge, to protect the guiding arrangement from undesired intrusion by dust particles and such.

12 Claims, 4 Drawing Sheets

PUSH BUTTON SWITCH WITH ANTI-JAMMING PROTECTION DEVICE

FIELD OF THE INVENTION

The present invention refers to electric switches, and more particularly to a push button switch.

BACKGROUND INFORMATION

A push button switch 1 of this type, as illustrated in FIG. 1 and discussed for example in published international patent application WO 2006/1065554, includes a support structure 2, or casing, of insulating material, having a generally box-like shape and defining an internal space for housing and supporting the electro-mechanical components of the switch. The support structure 2 has an opening 3, through which the internal space is connected to the outside of the support structure 2.

The push button switch 1 moreover includes an actuation mechanism 4, having a push button 5, which may be coupled with the support structure 2 for closing its opening 3. The actuation mechanism 4 also includes a coupling arrangement 6 for coupling the push button 5 to the support structure 2 in order to allow a relative guided sliding movement of push button 5 with respect to support structure 2. The sliding is required for controlling, by push button 5, an electrical switching of switch 21, which is performed, in practice, by rotating an oscillating switching member 10, for establishing/interrupting electrical connections by interacting with fixed electrical contact elements housed in the box-like structure 2, not shown in FIG. 1. In particular, the actuation mechanism 4 includes a pressure transmission arrangement 7, a rotating block 8 and a spring loaded pin 9 adapted to cooperate with the oscillating switching member 10.

The push button 5 includes a front portion provided by a key 11, and the switch 1 includes a key cover 12 which may be associated with the key 11.

In order to avoid possible jamming of push button 5 in the box-like structure 2, which is likely in particular when the push button 5 is for example subject to a manually exerted pressing force in a position which is distinct from a generally central portion of push button 5, in the above international patent application WO 2006/106554, a solution has been proposed, in which the coupling arrangement 6 is provided, which are disposed between the push button 5 and the box-like structure 2, comprising a retaining and guiding frame 6 for push button 5, which may be fixed to the support structure 2, by two small hooks 13, and which may be interposed between the push button 5 and the support structure 2.

The applicant, based on field tests, has observed that in particular when tolerances between the push button 5 and retaining and guiding frame 6 are relatively small, for example, but not exclusively, as described in the international patent application WO 2006/106554, wherein the push button 5 and frame 6 form a directly assembled cinematic system, a undesirable intrusion of dust or sand particles and construction materials and similar may occur in the sliding areas defined between the push button 5 and retaining and guiding frame 6.

Such undesirable intrusion may in some case inhibit the sliding of push button 5 with respect to the retaining and guiding frame 6, therefore causing the actuation mechanism 4 to jam.

An object of the exemplary embodiments and/or exemplary methods of the present invention is to provide a switch with a push button actuation system, which is such as to solve the above problem with reference to the switches of the known art.

This object is achieved by a push button switch, as generally defined herein. Exemplary and advantageous embodiments of the present invention are also further defined herein.

The exemplary embodiments and/or exemplary methods of the present invention may be better understood from the following detailed description of a particular illustrative and therefore non-limiting embodiment, with reference to the appended drawings. In the drawings, same or like elements are indicated by the same reference numerals.

DETAILED DESCRIPTION

Figure 1:
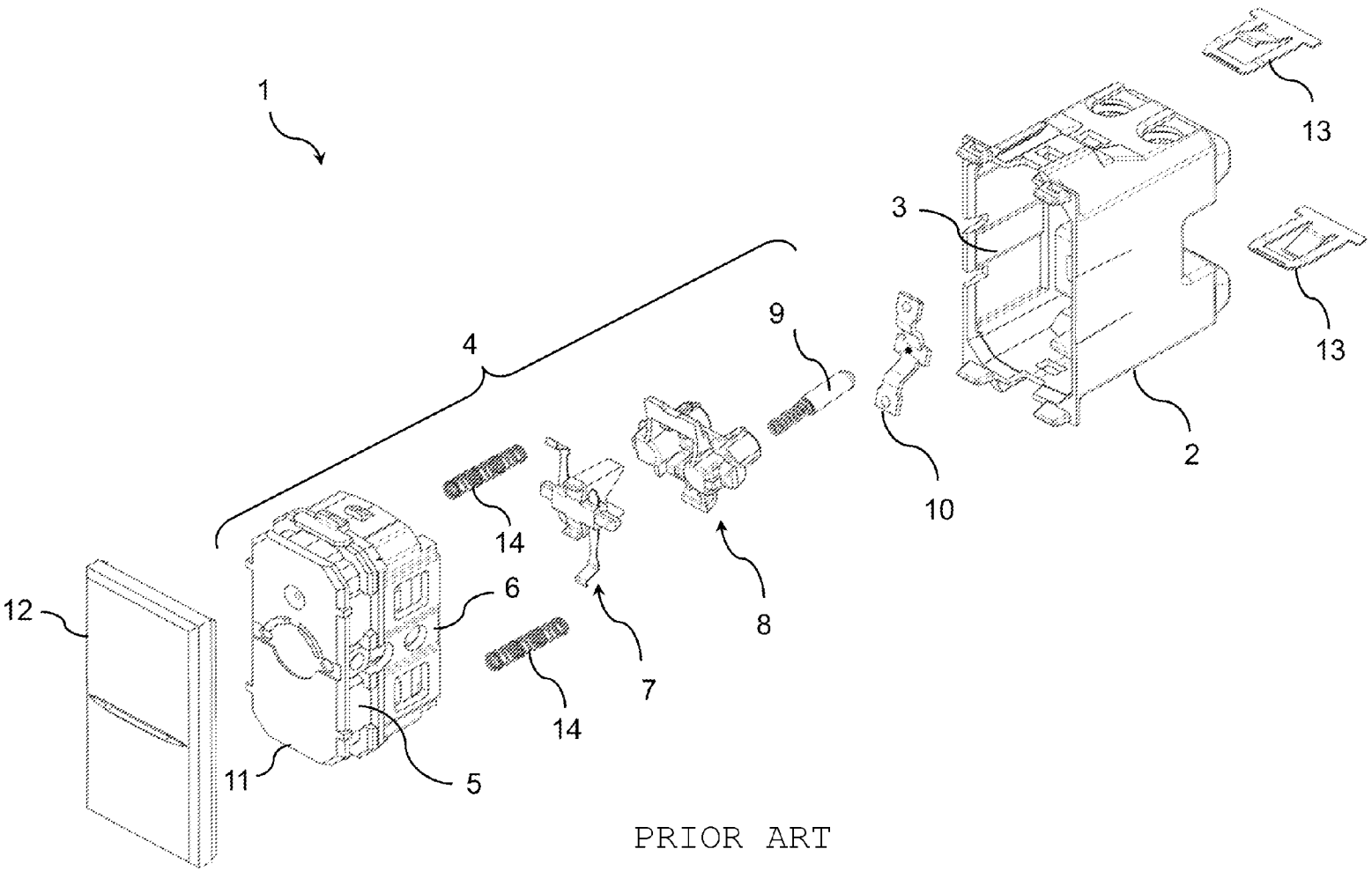
PRIOR ART FIG. 1
FIG. 1 shows a perspective exploded view of a push button switch according to the prior art.
Figure 2:
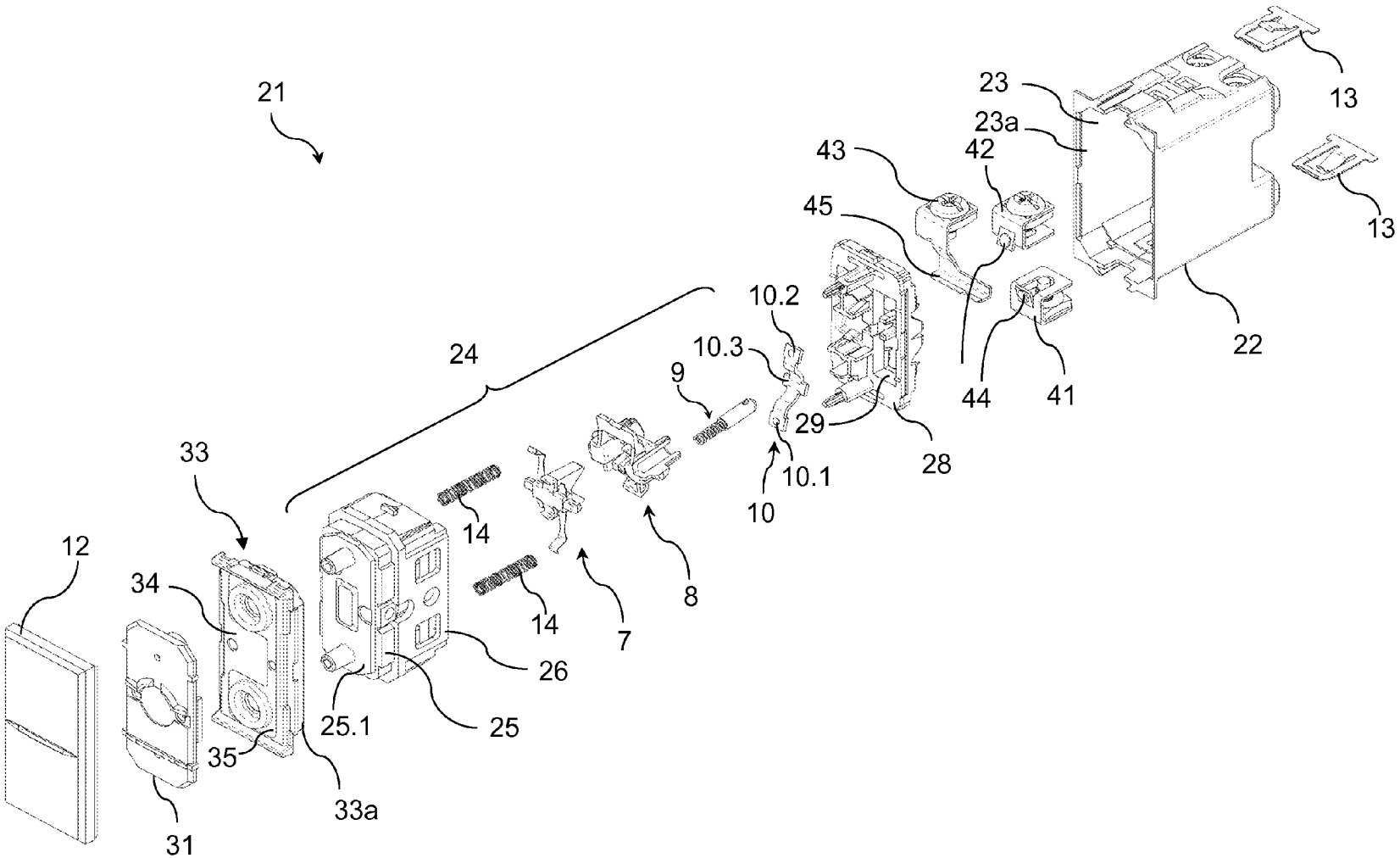
FIG. 2 shows a perspective exploded view of a push button switch according to the present invention.
Figure 3:
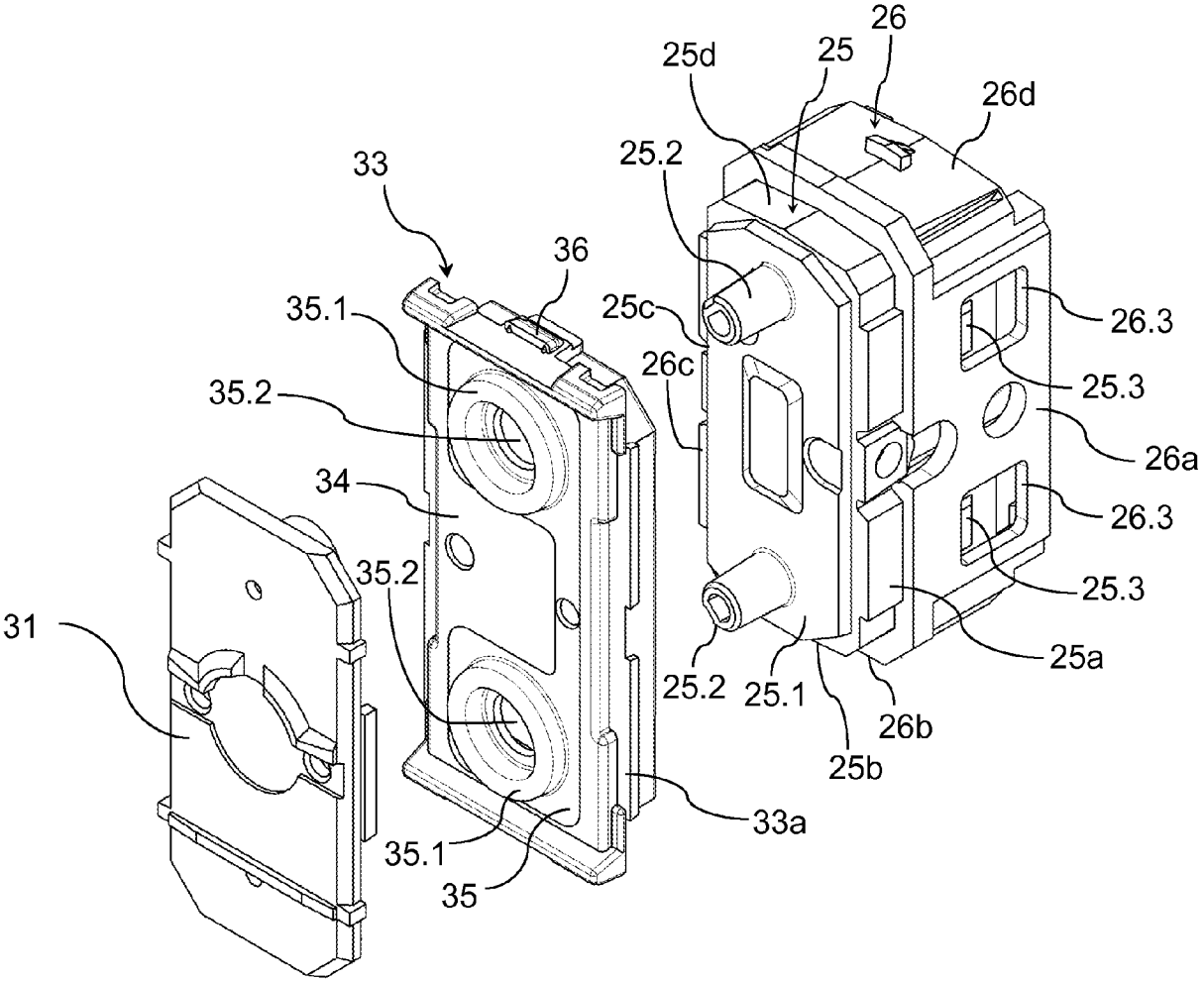
FIG. 3 shows in greater detail some of the parts of switch of FIG. 2.
Figure 4:
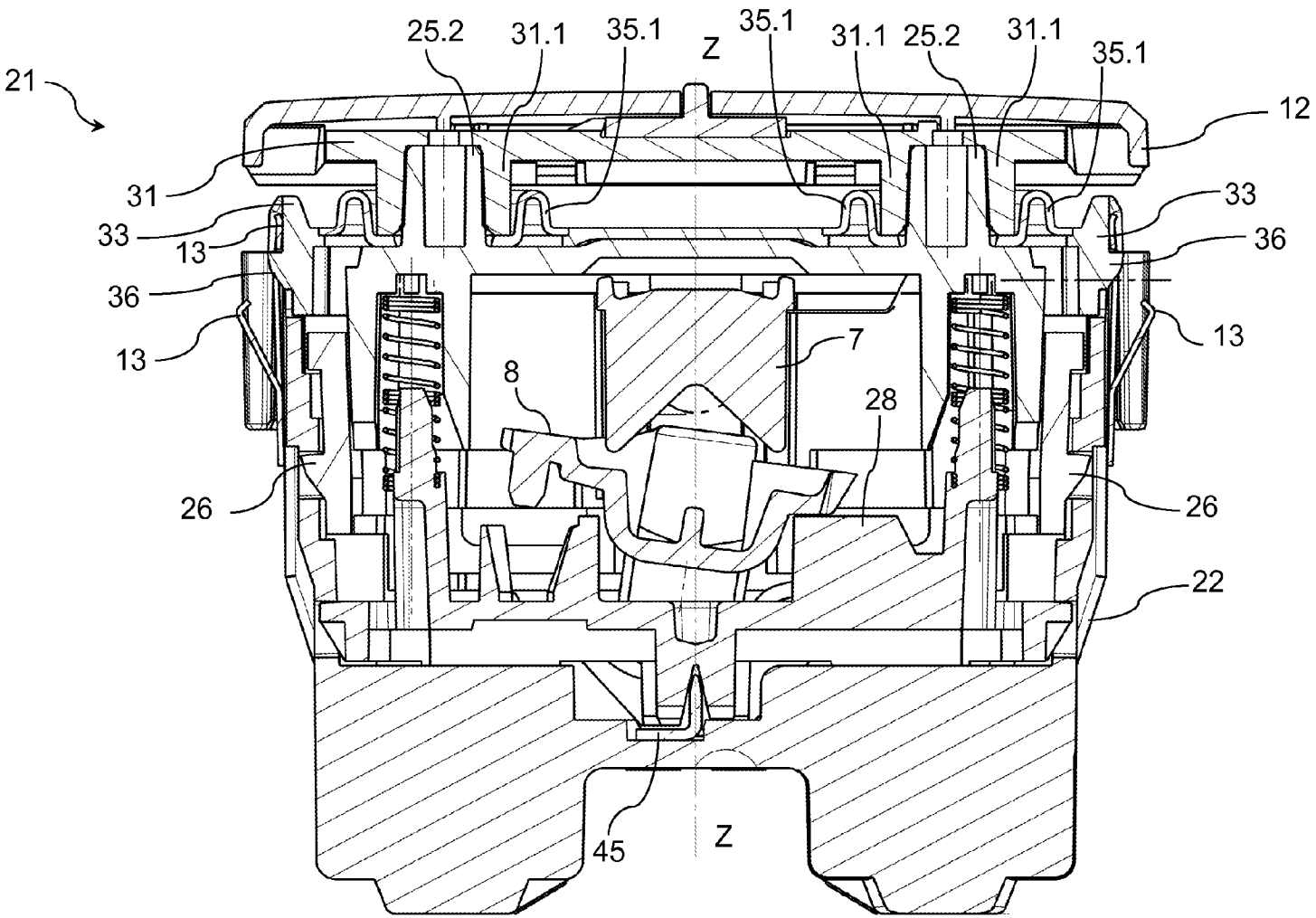
FIG. 4 shows a lateral sectional view of the push button switch of FIG. 2.

Referring to FIGS. 2, 3 and 4, a particular exemplary embodiment of a push button switch according to the present invention is shown, which is generally indicated by 21. This switch may be of the modular type, i.e. it is to be installed in a support frame for wall mounting, beside other switches of the same type, or generally beside other electrical modular apparatus, such as electrical sockets.

In the exemplary embodiments and/or exemplary methods of the present invention, by switch a single contact opening and closing device as well as an opening contact device with simultaneous closing of another contact and vice versa (diverter) are intended.

The switch 21, shown in FIG. 2 with partially separated parts, comprises a support structure 22 of insulating material, for instance plastic, having, in an exemplary and non-limiting way, approximately a parallelepiped shape with four lateral walls and a bottom wall.

The support structure 22, defines within lateral walls and a bottom wall an internal space communicating through a front opening 23 with the outside of the support structure 22. As shown in FIG. 4, the front opening 23 is provided with an opening axis Z-Z and is bounded by an inner edge 23*a* of the support structure 22.

In the internal space of the box-like structure 22 three electrical connection terminals 41, 42 and 43 are housed. Two of such terminals 41, 42 have a respective fixed contact 44 whereas the third terminal 43 carries a pivot 45, which in the example shown is formed by a conductive bar having an L shaped section.

In the described example, the push button switch 21 also includes a diaphragm 28 and an oscillating switching member 10 for establishing electrical connections, which in the particular example are provided by a rotatable metal bridge 10. In the example described, the rotatable bridge 10 is a rocker with a central rounded profile, which is positioned in the internal space of support structure 22. The rotatable bridge 10 comprises an abutting central portion 10.3, which through an opening 29 formed in the diaphragm 28 contacts the pivot 45, and also comprises two arms having mobile electrical contacts 10.1, 10.2 at the respective ends. The bridge 10 is such as to be rotated about its central abutting portion, in order to establish/interrupt electrical connections.

The push button switch 21 further comprises an actuation mechanism 24 which may be coupled to the support structure 22.

The actuation mechanism 24 comprises a push button 25 and a mechanical coupling arrangement 26 for coupling the push button 25 to the support structure 22 in order to fix the push button 25 to the support structure 22. The mechanical coupling arrangement includes a guiding arrangement 26 for allowing the push button 25 to move with respect to the support structure 22 in a direction which is substantially parallel to the opening axis Z-Z. In a particularly advantageous embodiment, the guiding arrangement advantageously includes a retaining and guiding frame 26 for push button 25. The retaining and guiding frame 26 may be fixed, in an exemplary and non-limiting way, by clamping to the support structure 22. The retaining and guiding frame 26 may be inserted into the front opening 3 for being at least partially received inside the internal space of support structure 22. In a particularly advantageous embodiment, the retaining and guiding frame 26 is totally received in the internal space of support structure 22. The retaining and guiding frame 26 may be made according to already cited international patent application WO 2006/106554.

The push button 25 may include an upper portion having a plate 25.1 and may also include a lower portion formed by lateral push button walls 25*a*, 25*b*, 25*c*, 25*d*, which perpendicularly protrude from plate 25.1.

Advantageously, the retaining and guiding frame 26 comprises lateral walls 26*a*, 26*b*, 26*c*, 26*d* which annularly surround the push button 25, in order to envelope the lower portion 25*a*, 25*b*, 25*c*, 25*d* of push button 25. In a particularly advantageous embodiment, the lateral walls of frame 26*a*, 26*b*, 26*c*, 26*d* on the side directed towards the push button 25 have surfaces, provided with protrusions and recesses, which are substantially counter-shaped with respect to corresponding surfaces of lateral walls 25*a*, 25*b*, 25*c*, 25*d* of the push button, which face the retaining and guiding frame 26. In practice, protrusions of lateral frame walls 26*a*, 26*b*, 26*c*, 26*d* are received in corresponding recesses of push button walls 25*a*, 25*b*, 25*c*, 25*d* and vice versa, in order to define a plurality of guides provided in the thickness of lateral walls of frame 26 and push button 25.

Advantageously, the push button 25, due to the interaction of lateral push button walls 25*a*, 25*b*, 25*c*, 25*d* with lateral frame walls 26*a*, 26*b*, 26*c*, 26*d*, is slidingly constrained by the retaining and guiding frame 26 in order to traverse in a guided way with respect to the same, in a direction which is substantially parallel to opening axis Z-Z. In particular, the push button 25 may traverse, sliding in the retaining and guiding frame 26, along a path between a first end position, in which, as shown in FIG. 3, the push button 25 is in a distal position with respect to frame 26 and a second end position (not shown), in which the push button 25 is in a proximal position with respect to frame 26.

In a particularly convenient embodiment, the push button 25 and guiding frame 26 form a directly assembled cinematic system which comprises two almost irreversibly coupled elements 25, 26, i.e. which cannot be easily separated from each other without structurally damaging these elements. For example, push button 25 and retaining and guiding frame 26 are composed of two distinct chemically non adhesive materials, by a co-molding technique comprising two sequential successive accretions. Such a co-molding technique is described, for example, in the European patent application number EP 1386716.

In a particularly advantageous embodiment, at least two lateral mutually opposed push button walls 25*a*, 25*b*, 25*c*, 25*d* comprise protruding end-stop elements 25.3, which project from push button lateral walls towards corresponding lateral frame walls. In the thickness of the lateral frame walls pockets (i.e. blind cavities) or windows (i.e. through openings) 26.3 are provided, which receive the protruding end-stop elements 25.3. In FIG. 3, two openings 26.3 are partially visible, which are formed in the lateral wall 26*a* of frame 26. Corresponding openings are provided in the wall 26*c* of frame 26.

The push button switch 21 further includes an elastic pushing arrangement 14 for retaining the push button 25 in its distal position with respect to guiding frame 26, i.e. in a distal position with respect to support structure 22. This distal position represents the rest position of push button 25. In the example described, the elastic pushing arrangement includes, without any limitation, two helical pressure springs 14, with respective second ends abutting against a surface of plate 25.1 which is directed towards the internal space of supporting structure 22.

As shown in FIG. 2, the actuation mechanism 24 may include a control element 8, 9 having a block 8 of insulating material and a spring-loaded pin 9, and may also have a pressure transmission arrangement 7. Without any limitation, the above mentioned components 7, 8 and 9 may be structurally realized and functionally operative according to European patent EP 1 584 096 and/or international patent application WO 2006/106554.

The push button 21 also includes a key 31, or counter-button, which may be fixed to push button 25 for manually actuating the same. The switch 21 may also include a key cover 12, which may be coupled to key 31 for aesthetic reasons.

The push button switch 21 further includes an anti-jamming protection device 33, having a protective plug, which may be interposed between the push button 25 and key 31 and which can be coupled to support structure 22 for protecting the guiding arrangement 26 from undesirable intrusion of dust particles and similar.

The protective plug 33 may be applied on the support structure 22 at the front opening 3 of same, and is advantageously fixable to support structure 22 for cooperating with the internal edge 23*a* of support structure 22 surrounding the front opening 3. In other words, an external peripheral edge 33*a* of protective plug 33 is such as to cooperate with the internal edge 23*a* of front opening 3. In this way, the protective plug 33 passes through the opening 23 and is at least partially received in the internal space of support structure 22. This advantageously allows a limitation of size, i.e. avoids a substantial increase in size with respect to a switch without the anti-jamming protection device 33. This solution also advantageously does not interfere with a modular installation of switch, since it does not substantially increase the modular size (height, width) of switch.

In a particularly advantageous embodiment, the protective plug 33 includes a relatively rigid portion 34, having an arrangement 36 for fixing the plug 33 to the box-like structure 22, and a relatively flexible portion 35, which may be an elastic membrane, which is integral with the relatively rigid portion 34 and is internal with respect to the latter, the two portions being made of different materials with different flexibility characteristics. Without any limitation, the relatively rigid portion may be made of polypropylene reinforced by glass fibers whereas the relatively flexible portion 35 is made of a thermoplastic elastomer SEBS (Styrene-Ethylene-Butadiene-Styrene).

It is to be noted that according to the particularly advantageous embodiment, which is shown in the figures, the relatively rigid portion is provided by a frame which completely surrounds the relatively elastic portion 35. As in the example shown, in a plan view, the latter may be "C"-shaped or "U"-shaped.

In the example shown, the relatively rigid portion 34 comprises two opposed protruding teeth 36 for clamping the protective plug 33 to the box-like structure 42 by respective metal flaps 13. Such metal flaps 13 may also hook the switch 21 to a mounting frame (not shown).

In a particularly advantageous embodiment, the protective plug 33 is a one-piece solid device, wherein the relatively rigid portion 34 and the relatively flexible portion 35 are fabricated by a co-molding technique using two chemically adhering materials.

The protective plug 33 may be provided with at least a through opening 35.2 through which fixing arrangements 31.1, 25.2 may pass, which are provided for fixing the key 31 to push button 25. In the described example, in particular, two openings 35.2 are provided, which are formed in the relatively flexible wall 35 and the fixing arrangement for fixing key 31 to push button 25 comprise a pair of pins 25.2 provided on push button 25 and a pair of bushings 31.1 provided on key 31 for receiving a respective pin 25.2 of push button 25. As may be seen in FIG. 4, a respective pin 25.2 passes through each of the two openings 35.2.

In a particularly advantageous embodiment, the relatively flexible portion 35 of protective plug 33 comprises a sealing edge 35.1 surrounding the plug opening 35.2, and which deforms in order to follow the push button movements. In particular, in the described example two sealing edges 35.1 are provided, each with a substantially wavy profile associated to a respective opening 35.2. In a particularly advantageous embodiment it is also possible to provide, as shown in FIG. 4, sealing edges 35.1 which are internally clamped between the key 31 and push button 25.

From the above description it is possible to understand that the switch according to the invention fully accomplishes the required task. It is in fact to be noted that the provision of a protective plug of the above type advantageously allows avoiding undesirable intrusions of dust and similar material inside the sliding areas and therefore avoiding the jamming problem of above push button switch of the known art.

The skilled in the art, in order to satisfy contingent and specific needs, may introduce numerous modifications and variants to the above push button switch, all contained in the protection scope of the present invention.

The invention claimed is:

1. A push button switch, comprising:

a support structure having a generally box-like shape, defining an internal space, the support structure having at least an opening communicating with the internal space and an opening axis, wherein the opening is defined by an internal opening edge;

an actuation mechanism having a push button and a mechanical coupling arrangement for connecting the push button to the support structure, wherein the mechanical coupling arrangement includes a guiding arrangement for allowing the push button to traverse with respect to the support structure in a direction generally parallel to the opening axis; and a key which is fixable to the push button for manually actuating the push button;

wherein the switch includes an anti-jamming protection device having a protective plug, which is to be interposed between the key and the push button and which is appliable onto the support structure for interacting with the internal edge so as to protect the guiding arrangement from undesired intrusion by dust particles and other similar particle, wherein the guiding arrangement includes a retaining and guiding frame for the push button, which is fixable to the support structure and which is interposable between the push button and the structure, wherein the retaining and guiding frame is completely received in the internal space, and wherein the protective plug has at least an opening, through which the fixing arrangement may pass, which is provided for fixing the key to the push button.

2. The push button switch of claim 1, wherein the push button and the retaining and guiding frame form a directly assembled mechanism, including two irreversibly coupled elements.

3. The push button switch of claim 1, wherein the retaining and guiding frame and the push button are made of two distinct and chemically non-adhesive materials, by a co-molding technique which includes two sequential successive accretions.

4. The push button switch of claim 1, wherein the protective plug includes a relatively rigid portion having a hooking arrangement to fix it to the support structure, and having a relatively flexible portion fixed to the relatively rigid portion, and wherein the relatively rigid portion and the relatively flexible portion are made of two distinct materials.

5. The push button switch of claim 1, wherein the relatively rigid portion and the relatively flexible portion are manufactured by a co-molding technique.

6. The push button switch of claim 4, wherein the relatively flexible portion includes an elastic membrane.

7. The push button switch of claim 1, wherein the opening of the plug is defined in the relatively flexible portion.

8. The push button switch of claim 7, wherein the relatively flexible portion includes a sealing edge surrounding the opening of the plug, which is deformable so as to follow movements performed by the push button.

9. The push button switch of claim 8, wherein the sealing edge has a wavy profile.

10. The push button switch of claim 8, wherein the sealing edge is clamped between the push button and the key.

11. The push button switch of claim 4, wherein the flexible portion is one of substantially "C"-shaped and substantially "U"-shaped.

12. The push button switch of claim 1, wherein the protective plug passes through the opening.

* * * * *

UNITED STATES PATENT AND TRADEMARK OFFICE

CERTIFICATE OF CORRECTION

PATENT NO. : 8,698,026 B2
APPLICATION NO. : 13/054319
DATED : April 15, 2014
INVENTOR(S) : Pietro Roceereto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 315 days.

Signed and Sealed this
Twenty-ninth Day of September, 2015

Michelle K. Lee

Michelle K. Lee
*Director of the United States Patent and Trademark Office*